US007377281B2

(12) United States Patent
Bachmann

(10) Patent No.: US 7,377,281 B2
(45) Date of Patent: May 27, 2008

(54) CONE WRAPPER FOR THE CONSUMPTION OF SMOKABLE SUBSTANCES

(75) Inventor: Charles Bachmann, Phoenix, AZ (US)

(73) Assignee: BBK Tobacco & Foods, Inc., Phoenix, AZ (US)

( * ) Notice: Subject to any disclaimer, the term of this patent is extended or adjusted under 35 U.S.C. 154(b) by 499 days.

(21) Appl. No.: 10/922,048

(22) Filed: Aug. 19, 2004

(65) Prior Publication Data

US 2006/0037622 A1 Feb. 23, 2006

(51) Int. Cl.
*A24F 47/00* (2006.01)

(52) U.S. Cl. ..... 131/347; 131/365; 131/360

(58) Field of Classification Search ..... 131/70, 131/73, 191, 347, 365, 360
See application file for complete search history.

(56) References Cited

U.S. PATENT DOCUMENTS 1,145,268 A * 7/1915 Rossy ..... 53/465
1,479,458 A * 1/1924 De La Mota ..... 131/360
1,631,048 A * 5/1927 Miller ..... 206/265
1,995,068 A * 3/1935 Lim ..... 131/360
4,104,431 A 8/1978 Luke
4,290,592 A 9/1981 Kastner
4,775,358 A 10/1988 Jones
4,832,057 A 5/1989 Bale
5,464,073 A * 11/1995 Johannes ..... 187/334
5,645,089 A * 7/1997 Burger et al. ..... 131/365
5,762,074 A * 6/1998 Garner ..... 131/360
5,782,246 A * 7/1998 Axelrod ..... 131/364
5,927,488 A 7/1999 Gray
6,000,404 A 12/1999 Case et al.
6,164,443 A 12/2000 Mitchell et al.
6,357,448 B1 * 3/2002 Sinclair, Jr. ..... 131/365
6,526,986 B1 * 3/2003 Sinclair, Jr. ..... 131/365
6,571,803 B1 6/2003 Bregard
6,638,613 B1 10/2003 Bland
6,742,525 B2 * 6/2004 Sinclair, Jr. ..... 131/365
6,854,471 B1 * 2/2005 Sinclair, Jr. ..... 131/347
D526,086 S * 8/2006 Mehta ..... D27/101

(Continued)

FOREIGN PATENT DOCUMENTS

DE 33 00 302 A1 7/1984

(Continued)

OTHER PUBLICATIONS

Written Opinion U.S. Appl. No. 04/029882, Apr. 21, 2005.

*Primary Examiner*—Carlos Lopez
(74) *Attorney, Agent, or Firm*—Chris P. Perque; Gardere Wynee Sewell LLP

(57) ABSTRACT

The present invention provides a product and method of making thereof for the consumption of smokable substances such as tobacco or herbs. The product is comprised of tobacco, homogenized tobacco and/or natural leaf materials and has a hollow conical shape that allows for the easy insertion of smokable substances and further provides for larger amounts of smokable substances in the end of the product the consumer lights, resulting in an initial slower prolonged burn and more even distribution of nicotine. Additionally, the placement of a structure into one end of the hollow cone permits the consumer to consume the majority, if not all, of the smokable substance. This structure also prevents debris and other unwanted materials from being sucked through the end of the product and into the mouth and respiratory system of the consumer.

11 Claims, 2 Drawing Sheets

U.S. PATENT DOCUMENTS

| | | | | |
|---|---|---|---|---|
| 7,172,672 | B2 | 2/2007 | Silverbrook | |
| 2002/0083952 | A1* | 7/2002 | Braun | 131/235.1 |
| 2005/0072437 | A1 | 4/2005 | Gomez | |
| 2005/0072439 | A1* | 4/2005 | Darwish | 131/347 |
| 2006/0000481 | A1 | 1/2006 | Sinclair, Jr. | |
| 2006/0083886 | A1 | 4/2006 | Harrison et al. | |

FOREIGN PATENT DOCUMENTS

| | | | |
|---|---|---|---|
| DE | 94 14 404 | U1 | 2/1995 |
| DE | 195 31 061 | A1 | 2/1997 |
| DE | 20 2004 007772 | U1 | 10/2004 |
| EP | 0 934 703 | A1 | 12/1998 |
| GB | 2 336 989 | A | 11/1999 |
| WO | WO 97/25886 | * | 7/1997 |
| WO | WO 98/20757 | A | 5/1998 |
| WO | WO 03/020057 | A | 3/2003 |
| WO | PCT/US/2004/029882 | | 4/2005 |

* cited by examiner

CONE WRAPPER FOR THE CONSUMPTION OF SMOKABLE SUBSTANCES

FIELD OF THE INVENTION

The present invention relates generally to products for the consumption smokable substances, and more particularly to a product and method of making thereof for the consumption of tobacco and other smokable substances having a hollow conical shape.

BACKGROUND OF THE INVENTION

A segment of the smoking population enjoys smoking hand rolled cigars or cigarettes. Typically, these individuals purchase rolling papers, tobacco leaves or cigar wrapping materials and hand roll their preferred brand of crushed tobacco, or herbs such as cloves, into a custom-made cigarette or cigar. The result is a personally customized tobacco or herbal product with superior smell and taste than a prefabricated store bought product. Hand fabricating cigars or cigarettes is time consuming and requires finger dexterity and skill.

Prior art includes tobacco products formed by rolling moistened tobacco leaves about a cylindrical form casing to form a shell whereby a consumer can fill the shell with crushed tobacco. In one embodiment of the prior art a slit is formed through a wall of the shell to allow prying open of the shell to insert the crushed tobacco. The slit must then be closed and sealed again prior to smoking the product. In another embodiment, a funnel is used to deposit the crushed tobacco into the ends of the cylindrical shell.

Disadvantages of these prior art tobacco products include: extended time and requisite finger dexterity required to place crushed tobacco in the end openings of a prefabricated cylindrical shell; extended time and requisite finger dexterity required to pry open a slit in the prefabricated shell and place crushed tobacco into the shell; wasted tobacco or herbal product resulting from the end, or butt, of the cigar or cigarette becoming unholdable due to increased temperatures as the product burns during consumption; tobacco debris sucked through the end of the tobacco product during consumption that ends up in the mouth or respiratory system of the consumer; fast burn rates at the end of the cigar the consumer lights—the end many consumers assert has the best flavor and is most enjoyable; and uneven distributions of nicotine—the result of a generally cylindrically shaped product burning during consumption.

The present invention addresses these problems by providing a product for the consumption of smokable substances with a novel shape and construction that is easy to utilize and provides for a consistent quality smoke.

SUMMARY OF THE INVENTION

The present invention provides a product, and method of making thereof, for consumption of tobacco, herbs and other similar smokable substances. The hollow conical shape of the product allows for the easy insertion of the smokable substance. The hollow conical shape further permits easy insertion of larger amounts of smokable substances into the end of the product the consumer lights, resulting in an initial slower prolonged burn and more even distribution of nicotine. Additionally, the placement of a structure into one end of the hollow cone permits the consumer to consume the majority, if not all, of the smokable substance. This structure further prevents debris and other unwanted materials from being sucked through the end of the product and into the mouth and respiratory system of the consumer. The result is a product that is easy to use and provides for a superior smoke.

The present invention is generally comprised of a first sheet (or sheets) of material, the sheet (or sheets) forming a hollow cone, the hollow cone having a first end defining a first opening and a second end defining a second opening whereby the second opening has a diameter greater than the diameter of the first opening. The first sheet (or sheets) of material is comprised of tobacco, homogenized tobacco and/or natural leaf materials. Additionally, the present invention may have a second sheet (or sheets) of material disposed within the first end of the hollow cone. The second sheet (or sheets) of material may form a coil. The present invention may further comprise a container for packaging the hollow cone whereby the cone will be protected and not lose its shape. Additionally, the present invention may further comprise an elongated member for packing smokable substances into the hollow cone. The unique shape and structure of the present invention provides for the advantages set forth above.

The new method of making the above mentioned product for the consumption of tobacco and other smokable substances results in a product that is easy to use and provides for a consistent quality smoke. Further, the number of steps required for the consumer to produce a final customized smoke is reduced as compared to prior art methods. In accordance with one preferred embodiment, the method includes the steps of providing a first sheet (or sheets) of material, the first sheet of material comprised of tobacco, homogenized tobacco and/or natural leaf material; cutting the first sheet (or sheets) of material to a desired size; and forming the first sheet (or sheets) into a hollow cone, the hollow cone having a first end defining a first opening and a second end defining a second opening whereby the second opening has a diameter greater than the diameter of the first opening. The method may further comprise the step of placing a second sheet (or sheets) of material within the first end of the hollow cone or it may further include the step of attaching a second sheet (or sheets) of material to the first sheet (or sheets) of material prior to forming the hollow cone, whereby when the hollow cone is formed the second sheet of material is disposed within the first end of the hollow cone. The second sheet (or sheets) of material may form a coil. The method may also include the step of packaging the hollow cone in a container. Additionally, the method may also include the step of providing an elongated member to assist in packing tobacco or herbs into the hollow cone.

PREFERRED EMBODIMENTS OF THE INVENTION

In the following detailed description of the preferred embodiments, reference is made to the accompanying drawings, which form a part hereof, and in which are shown by way of illustration specific embodiments in which the invention may be practiced. It is to be understood that other embodiments may be utilized and structural changes may be made without departing from the scope of the present invention.

Figure 1:
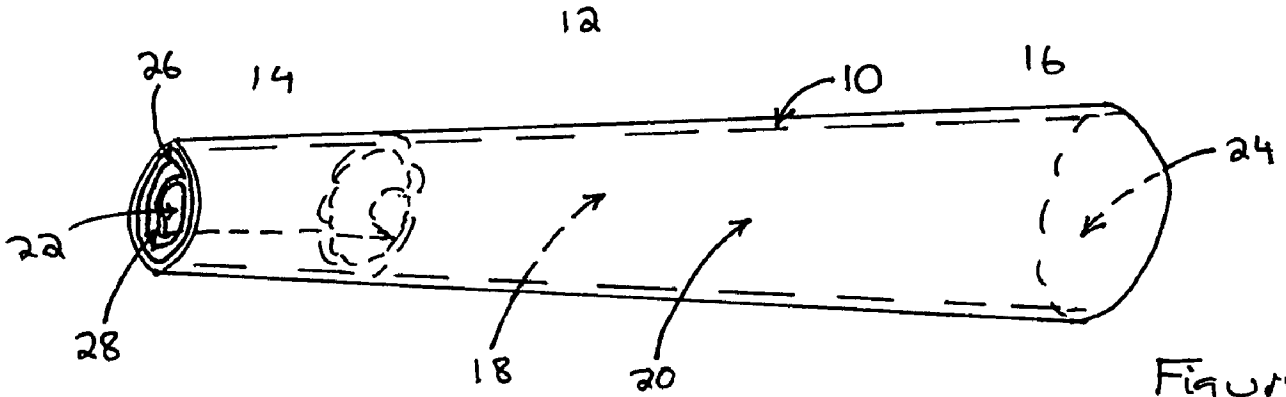
FIG. 1 is a perspective view of one embodiment of a product for the consumption of smokable substances.

FIG. 1 is a perspective view of one embodiment of a product for the consumption of smokable substances provided by the present invention having a first sheet 10 of material comprised of tobacco, homogenized tobacco and/or natural leaf material such as plant leaves (e.g., banana, palm leaves, etc.) and the like. The first sheet 10 forming a hollow cone 12. The hollow cone 12 can be made to any desired length. The hollow cone 12 having a first end 14, a second end 16, an inner surface 18 and an outer surface 20, the first end 14 having a first opening 22 and the second end 16 having a second opening 24 whereby the second opening 24 has a diameter greater than the diameter of the first opening 22. A second sheet 26 of material may be disposed within the first end 14 of the hollow cone 12. The second sheet 26 may form a coil 28. The second sheet 26 may generally have a conical shape inside the first end 14. Additionally and/or alternatively, a filter, such as a filter used in standard cigarette products, may be disposed within the first end 14 of the hollow cone 12. The hollow cone 12 may be comprised of multiple first sheets 10 and multiple second sheets 26. Additionally, moisture and flavors may be added (by methods known to one skilled in the art such as spraying a mist, brushing or dipping the sheets of flammable material into a vat of hydrant or flavor mixture, etc.) to first sheet or sheets 10.

Figure 2:
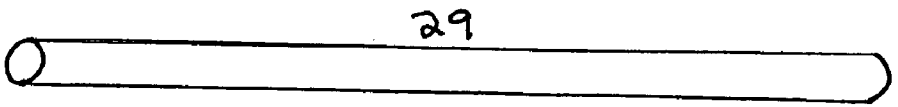
FIG. 2 is a perspective view of one embodiment of an elongated member for packing tobacco or herbs into a product for the consumption of smokable substances.

FIG. 2 is a perspective view of one embodiment of an elongated member 29 that may be used to pack, i.e. compact, crushed tobacco or herbs into hollow cone 12. Elongated member 29 may be comprised of a bamboo stick or other similarly shaped material. Further, elongated member may have different shaped ends to facilitate the packing process such as a bulb or enlarged surface on one end and a grip on the other.

Figure 3:
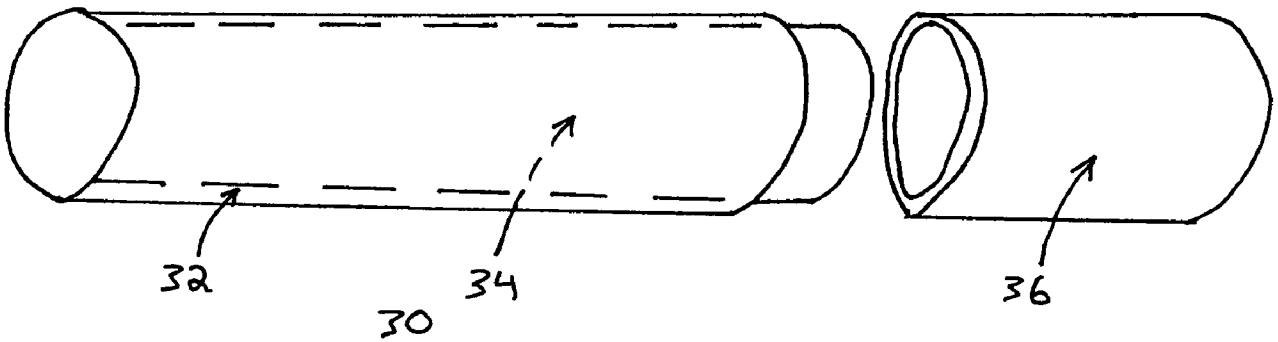
FIG. 3 is a perspective view of one embodiment of a container for packaging a product for the consumption of smokable substances.

FIG. 3 is a perspective view of one embodiment of a container 30 for packaging the hollow cone 12. The container 30 comprises a hollow tube 32 having a longitudinal bore 34 for receiving the hollow cone 12. The container 30 has at least one removable cap 36 attached to one end of the hollow tube 32. Alternatively, the hollow cone 12 may be left on a mold (described below) and then package in a container such as the container described above or a plastic or cellophane sleeve or container. Additionally, elongated member 29 may be packaged inside of container 30 or attached outside of container 30 utilizing an adhesive, wrapping or other method known to one of skill in the art.

Figure 4:
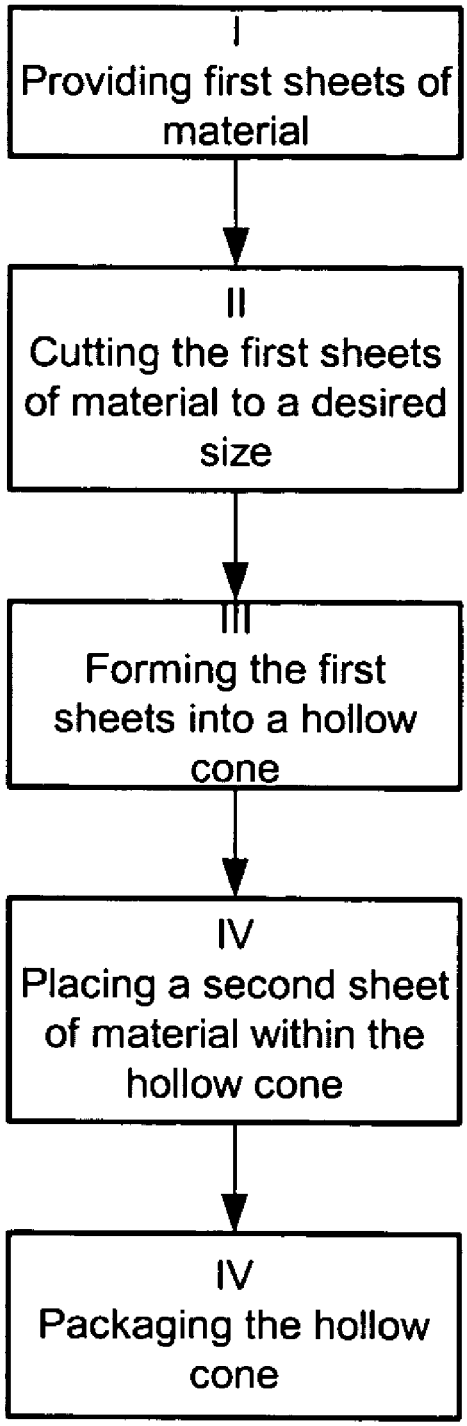
FIG. 4 is a flow sheet illustrating the steps of an embodiment of the process provided by the invention.

FIG. 4 illustrates the steps of an embodiment of the method provided by the invention. This method may be used to produce the product for the consumption of smokable substances illustrated in FIG. 1. Step I involves providing a first sheet (or sheets) of material. The first sheet (or sheets) of material comprised of tobacco, homogenized tobacco and/or natural leaf materials such as plant leaves (e.g., banana, palm leaves, etc.) and the like. Step II involves cutting the first sheet (or sheets) of material to a desired size. Step III involves forming the first sheet (or sheets) into a hollow cone, the hollow cone having a first end defining a first opening and a second end defining a second opening whereby the second opening has a diameter greater than the diameter of the first opening. Forming the first sheet (or sheets) into the hollow cone may be accomplished by hand or by utilizing a mold of a predetermined length and end diameters, whereby the first sheet (or sheets) of material are wrapped or rolled around the outside of the mold and then slightly compressed to cause them to adhere together. Alternatively, molds may be inserted into the first and/or second ends of the hollow cone after it has been formed. The mold, or molds, will cause the hollow cone to retain its shape. Additionally and/or alternatively an adhesive, such as glue, may be applied to the first and second ends of the hollow cone. The adhesive will assist in causing the hollow cone to retain its shape. Further, a small amount of moisture may be added to the first sheet (or sheets) of material to make it more pliable prior to forming the hollow cone. Once the hollow cone has been formed around the mold, or the molds have been inserted into the ends of the hollow cone, it is allowed to dry. When substantially dry, the hollow cone may be removed from the mold. To assist in removal of the dried hollow cone from the mold, the outer surface of the mold may be pre-coated with a non-stick material. Step IV involves placing a second sheet (or sheets) of material within the first end of the hollow cone. Step IV may be performed in conjunction with Step III whereby the second sheet (or sheets) of material may be placed in contact with the first sheet (or sheets) of material prior to forming the hollow cone, whereby when the hollow cone is formed (by hand, around a mold, etc.) the second sheet of material is disposed within the first end of the hollow cone. When Step III is performed in conjunction with Step IV, a portion of the second sheet (or sheets) may be attached to the inner surface of the first sheet (or sheets) of material and a portion of the second sheet (or sheets) may be left unattached such that when the hollow cone, including the second sheet (or sheets) connected therewith, are formed the unattached portion of the second sheet (or sheets) forms a loose coil inside the first end of the hollow cone. Additionally and/or alternatively, a filter, similar to a cigarette filter, may be added to the first end of the hollow cone. Step V involves packaging the hollow cone in a container. The container may be comprised of a rigid material forming a hollow tube having a longitudinal bore for receiving the hollow cone. Also, an elongated member, such as a bamboo stick may be packaged with the hollow cone. Additionally, the step of adding flavoring and/or moisture to the sheets of flammable material (by methods known to one skilled in the art such as spraying a mist, brushing or dipping the sheets of flammable material into a vat of hydrant or flavor mixture, etc.) may be done at any time prior to Step V.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A product for consumption of tobacco and other smokable substances, comprising:

a first sheet of material forming a hollow cone having a first end defining a first opening and a second end defining a second opening whereby the second opening has a diameter greater than the diameter of the first opening, wherein the first sheet of material is tobacco, homogenized tobacco or natural leaf material; and a second sheet of material disposed within the first end of the hollow cone, wherein the second sheet of material forms a coil.

2. The product of claim 1, further comprising a plurality of second sheets of material.

3. A product for consumption of tobacco and other smokable substances, comprising:

a first sheet of material forming a hollow cone having a first end defining a first opening and a second end defining a second opening whereby the second opening has a diameter greater than the diameter of the first opening, wherein the first sheet of material is tobacco, homogenized tobacco or natural leaf material; and a second sheet of material disposed within the first end of the hollow cone, wherein the second sheet of material is attached to the hollow cone and wherein the second sheet of material forms a coil.

4. The product of claim 3, further comprising a plurality of second sheets of material.

5. A product for consumption of tobacco and other smokable substances, comprising:

a first sheet of material forming a hollow cone having a first end defining a first opening and a second end defining a second opening whereby the second opening has a diameter greater than the diameter of the first opening, wherein the first sheet of material is tobacco, homogenized tobacco or natural leaf material; and a second sheet of material disposed within the first end of the hollow cone, wherein the second sheet of material is more rigid than the first sheet of material.

6. A method for producing a product for consumption of tobacco and other smokable substances, comprising the following steps:

providing a first sheet of material comprised of tobacco, homogenized tobacco or natural leaf material;

cutting the first sheet of material to a desired size;

forming the first sheet of material into a hollow cone, the hollow cone having a first end defining a first opening and a second end defining a second opening whereby the second opening has a diameter greater than the diameter of the first opening; and placing a second sheet of material within the first end of the hollow cone, wherein the second sheet of material forms a coil.

7. The method of claim 6, wherein a plurality of second sheets form the coil.

8. A method for producing a product for consumption of tobacco and other smokable substances, comprising the following steps:

providing a first sheet of material comprised of tobacco, homogenized tobacco or natural leaf material;

cutting the first sheet of material to a desired size;

forming the first sheet of material into a hollow cone, the hollow cone having a first end defining a first opening and a second end defining a second opening whereby the second opening has a diameter greater than the diameter of the first opening; and placing a second sheet of material in contact with the first sheet of material prior to forming the hollow cone, whereby when the hollow cone is formed the second sheet of material is disposed within the first end of the hollow cone, wherein the second sheet of material forms a coil.

9. The method of claim 8, wherein a plurality of second sheets form the coil.

10. A method for producing a product for consumption of tobacco and other smokable substances, comprising the following steps:

providing a first sheet of material comprised of tobacco, homogenized tobacco or natural leaf material;

cutting the first sheet of material to a desired size;

forming the first sheet of material into a hollow cone, the hollow cone having a first end defining a first opening and a second end defining a second opening whereby the second opening has a diameter greater than the diameter of the first opening; and attaching a second sheet of material to the first sheet of material prior to forming the hollow cone, whereby when the hollow cone is formed the second sheet of material is disposed within the first end of the hollow cone, wherein the second sheet of material forms a coil.

11. The method of claim 10, wherein a plurality of second sheets form the coil.

* * * * *